United States Patent [19]

Rebandt

[11] Patent Number: 4,479,807

[45] Date of Patent: Oct. 30, 1984

[54] GASOLINE-SUBSTITUTE FUEL

[76] Inventor: Ralph A. Rebandt, Woodhaven, Mich.

[21] Appl. No.: 472,939

[22] Filed: Mar. 7, 1983

Related U.S. Application Data

[63] Continuation of Ser. No. 223,814, Jan. 9, 1981, abandoned.

[51] Int. Cl.[3] ..... C10L 1/18; C10L 1/30

[52] U.S. Cl. ..... 44/56; 44/67

[58] Field of Search ..... 44/56, 67

[56] References Cited

U.S. PATENT DOCUMENTS

| | | | |
|---|---|---|---|
| 1,412,233 | 4/1922 | Ellis | 44/56 |
| 1,428,913 | 9/1922 | Schreiber | 44/56 |
| 1,527,504 | 2/1925 | Backhaus | 44/56 |
| 1,534,573 | 4/1925 | de la Riboisiére | 44/56 |
| 4,294,586 | 10/1981 | Cox | 44/56 |

*Primary Examiner*—Jacqueline V. Howard

*Attorney, Agent, or Firm*—Hauke & Patalidis

[57] ABSTRACT

A gasoline-substitute fuel for use in motor cars comprises a mixture consisting of 5–15% by weight of a monohydroxy alcohol containing one to four carbon atoms per molecule; 2–10% by weight of a conventional diesel fuel; and the balance consisting of a conventional gasoline.

8 Claims, No Drawings

GASOLINE-SUBSTITUTE FUEL

This is a continuation of application Ser. No. 223,814 filed Jan. 9, 1981 now abandoned.

Gasoline used as a fuel to provide propulsive power for motor vehicles is a petroleum distilate containing a mixture of hydrocarbons boiling within a range of about 75° C. to 200° C. Since the petroleums from different parts of the world contain hydrocarbons of widely different compositions, the hydrocarbon compositions of various gasolines can differ widely. However, this difference in composition is of little consequence since it is the combustion properties of the various gasolines which are important.

Combustion properties may be improved by subjecting the petroleum to processes which will increase the production of hydrocarbons promoting slower combustion, as well as processes which will increase the yield of hydrocarbons having boiling points within a desired temperature range. The petroleum may also be treated to remove undesirable components. Subsequent to the distilation process, the gasoline fraction is mixed with additives which will further reduce the rate of combustion, with detergents to reduce the fouling of engines, with additives which will increase the tolerance of the gasoline for water, etc.

Many years ago it was first proposed to add about 10% by volume of ethyl alcohol to gasoline. At that time the motivation behind such proposals was to reduce the surplus of corn which had become an economic problem. Corn could be made into ethyl alcohol which not only was itself a good fuel but which, when added to gasoline as a minor component, improved the anti-knock properties of the fuel mixture. However, the addition of ethyl alcohol to gasoline was never considered as a cost-effective way to improve the performance of gasoline and its use as a gasoline additive was never widely accepted.

As the price of petroleum has advanced sharply on the world market the economics of a gasoline-substitute fuel has improved and fuels consisting of 90% gasoline and 10% ethanol are widely sold under the designation "gasohol". While gasohol may be used in a conventional motor vehicle without any mechanical adjustment of engine parts, the lower calorific value of the alcohol component of the fuel produces a somewhat lowered engine performance. While this reduced performance may not be noticeable where the fuel contains only 10% alcohol, higher alcohol proportions could produce more noticeable performance effects which would render such fuel undesirable for use in an engine designed for, and adjusted to, operation with gasoline.

It is an object of this invention to provide an alcohol-containing gasoline which has an additional component which will counteract unwanted effects produced by the presence of the alcohol.

SUMMARY OF THE INVENTION

The present invention provides a gasoline-substitute fuel containing 5–15% by volume of an alcohol, 2–10% by volume of a conventional diesel fuel, and the balance consisting of a conventional gasoline.

DESCRIPTION OF THE PREFERRED EMBODIMENTS

As used herein the term "conventional gasoline" is a motor vehicle fuel as sold at a gasoline dealer's pump and includes additives such as detergents, organometallic compounds, etc., which upgrade the quality of the fuel. Such fuels have an octane number in excess of 80 and preferably at least 90.

As used herein the term "conventional diesel fuel" is a petroleum distilate boiling in a range higher than the boiling range of the gasoline fraction. Like gasoline, it can have a wide variety of hydrocarbon compositions and can have additives and certain hydrocarbon groups present to provide an optimum rate of combustion in a diesel engine. The cetane number of the fuel, which is a corollary with respect to diesel fuel of the octane number of gasoline, is not so important with regard to this invention as a conventional diesel fuel component of the gasoline-substitute of this invention is present only in a low proportion. Fuel used for home heating would be satisfactory for use in this invention and is therefore considered "conventional diesel fuel" as the term is used herein.

The alcohol used in the gasoline-substitute fuel of this invention is a monohydroxy alcohol containing 1–4 carbon atoms per molecule. Ethyl alcohol is the preferred alcohol of this group since for the most part the other members of the group are derived from non-renewable natural resources, whereas ethyl alcohol may be produced from grains such as corn. The calorific value of diesel fuel is greater than the calorific value of gasoline per unit of weight. In accordance with my invention, diesel fuel is added to gasohol to counteract the reduced calorific value of gasohol brought on by the presence of alcohol. This in turn enables the fuel of this invention to be interchangeably substituted with 100% gasoline for use in a motor vehicle engine. A higher proportion of alcohol than that used in 90–10 gasohol may be present without adversely affecting operation of the engine. A preferred range of composition is 5–15% by volume alcohol and 2–10% by volume of conventional diesel fuel with the balance conventional gasoline. Where the alcohol is present in a proportion of 10% by volume as in the conventional gasohol I prefer to have the conventional diesel fuel present to the extent of 5% by volume.

If alcohol is present at the low end of the preferred range, for example, 5% by volume, the conventional diesel fuel should also be present at the low end of the range, for example, 2%. If alcohol is present at the high end of the range, for example, 15%, the conventional diesel fuel should then be present at the high end of its range as well, for example, 10%.

The higher calorific value of the fuels of this invention, coupled with the anti-knock properties conferred by the alcohol, can provide increased mileage to motor vehicles using this fuel. Test drives under actual road conditions have provided increased mileage of as much as 20%.

The fuels of this invention are also further improved by addition of 0.015% to 0.030% by volume of combustion catalyst in the form of a metal organic compound such as that sold under the trademark "K. Dee" by K. Dee Marketing, Mt. View, CA 94043.

While the invention has been described with reference to certain specific embodiments it is obvious that there may be variations which fall properly within the scope of the invention. Accordingly, the invention should be limited in scope only as may be necessitated by the scope of the appended claims.

I claim:

1. A gasoline-substitute fuel consisting exclusively of 5–15% by volume of a monohydroxy alcohol containing 1–4 carbon atoms per molecule, 2–10% by volume of a conventional diesel fuel, and the balance by volume consisting of a conventional gasoline.

2. A gasoline-substitute fuel as claimed in claim 1 in which the monohydroxy alcohol is ethyl alcohol.

3. A gasoline-substitute fuel as claimed in claim 1 in which the alcohol is present in the proportion of 10% by volume and the diesel fuel in the proportion of 5% by volume.

4. A gasoline-substitute fuel as claimed in claim 1 in which the proportion of monohydroxy alcohol present is directly correlated with the proportion of conventional diesel fuel present within the given ranges.

5. A gasoline-substitute fuel consisting exclusively of 5–15% by volume of a monohydroxy alcohol containing 1–4 carbon atoms per molecule, 2–10% by volume of a conventional diesel fuel, 0.015% to 0.030% by volume of a metal-organic compound, and the balance by volume consisting of a conventional gasoline.

6. A gasoline-substitute fuel as claimed in claim 5 in which the alcohol is ethyl alcohol.

7. A gasoline-substitute fuel as claimed in claim 5 in which the alcohol is present in the proportion of 10% by volume and the diesel fuel in the proportion of 5% by volume.

8. A gasoline-substitute fuel as claimed in claim 5 in which the proportion of monohydroxy alcohol present is directly correlated with the proportion of conventional diesel fuel present within the given ranges.

* * * * *